US005533914A

United States Patent [19]

Sawada

[11] Patent Number: 5,533,914

[45] Date of Patent: Jul. 9, 1996

[54] ELECTRICAL CONNECTION TERMINAL

[75] Inventor: Yoshitsugu Sawada, Shizuoka, Japan

[73] Assignee: Yazaki Corporation, Tokyo, Japan

[21] Appl. No.: 364,494

[22] Filed: Dec. 27, 1994

[51] Int. Cl.[6] ..... H01R 13/187

[52] U.S. Cl. ..... 439/843; 439/851; 439/877

[58] Field of Search ..... 439/842, 843, 439/848, 851, 877, 879, 881

[56] References Cited

U.S. PATENT DOCUMENTS

| | | | |
|---|---|---|---|
| 4,128,293 | 12/1978 | Paoli | 439/843 |
| 4,550,972 | 11/1985 | Romak | 439/843 |
| 4,572,606 | 2/1986 | Neumann et al. | 439/843 |
| 4,662,706 | 5/1987 | Foley | 439/843 |
| 4,685,761 | 8/1987 | Locati | 439/843 |
| 4,780,097 | 10/1988 | Piscitelli | 439/843 |

*Primary Examiner*—David L. Pirlot

*Assistant Examiner*—Brian Biggi

*Attorney, Agent, or Firm*—Sughrue, Mion, Zinn, Macpeak & Seas

[57] ABSTRACT

An electrical connection terminal includes a male terminal having a rod-like male contact portion, a tubular female terminal having a through hole for receiving the male contact portion, a resilient contact member of an annular shape which is retained in the through hole along an axis A, and can be brought into surface-to-surface contact with the male contact portion, and a conductor clamping portion and a covering clamping portion which are formed integrally with the female terminal at a rear end portion thereof through a retaining step portion, and extend in the axial direction. The resilient contact member is made of a material having a good electrical conductivity, and has an integral clamping piece which extends through the through hole in the retaining step portion to the conductor clamping portion. The covering clamping portion fixedly clamps a conductor covering, and the conductor clamping portion fixedly clamps a conductor and the clamping piece together.

4 Claims, 3 Drawing Sheets

ELECTRICAL CONNECTION TERMINAL

BACKGROUND OF THE INVENTION

1. Field of the invention

This invention relates to an electrical connection terminal, and more particularly to an electrical connection terminal with an excellent electrical conductivity suited for a device requiring a large current.

2. Related art

As shown in FIGS. 6 and 7, as a conventional electrical connection terminal for a large current, there has heretofore been used a box-like female connection member which includes an electrical contact member mounted therein, this electrical contact member for receiving a male connection member including a rigid metal plate of a good electrical conductivity resiliently deformed into the shape of Ω. This female connection member comprises two elements, and one of them is a box-like female connection member body 100 which includes a bottom plate 101 of a U-shaped cross-section having a compressively-clamping conductor connection portion 102 formed at its rear portion, a pair of generally-upstanding side wall plates 103 spaced along the length of the bottom plate, and top plates 104 formed by bending distal portions of the side wall plates in such a manner that the top plates 104 are disposed parallel to the bottom plate 101. The other element is the electrical contact member 15, and the opposite end portions of the Ω-shaped metal plate are curved outwardly away from each other to provide diverging guide portions 106 for easily receiving a tongue-like male member. Throat portions 107 are continuous with the guide portions 106, respectively, and are projected inwardly toward each other for direct sliding contact with the tongue-like male member. A pair of upper and lower oppositely-extending, retaining projections 108 are provided at opposite ends of the electrical contact member 105 for positioning the electrical contact member between the pair of side wall plates and for contacting the contact member with the bottom plate 101. For assembling the electrical connection member, the retaining projections 108 are fitted between the pair of side wall plates 103 to position the electrical contact member 105, and then the side wall plates 103 and the upper plates 104 are bent until this portion is formed into a rectangular cross-section, thereby mounting the electrical contact member in the female connection member body 100. Further, a conductor 110 is received in the conductor clamping portion 102 while a conductor covering 109 is received in a covering clamping portion 103, and then these portions are compressed at their periphery, thus completing the assembling.

In use, a socket A (connected to an equipment) having a male connection member M is held between the throat portions 107 of the electrical contact member 105 mounted in the electrical connection member body 100. Therefore, electric current flows from the conductor 110 to the retaining projections 108 of the electrical contact member 105 through the conductor clamping portion 102, the bottom plate 101, the side wall plates 103 and the upper plates 104, and further flows to the male connection member M through the throat portions 107. Thus, the current flow into the male connection member via several point-contact portions.

Generally, when the above connection member is to be used in an equipment requiring a large current, it is necessary to take care to prevent the generation of heat and an arc. Therefore, it is necessary to reduce an electric resistance at the areas of contact between the two. To achieve this, it is important to eliminate as much as possible those areas of contact where the members of different electrical conductivities are contacted with each other. The reason is that current (general characteristics of electricity) flows from a high-resistance portion (low-conductivity portion) to a low-resistance portion (high-conductivity portion). If it is intended to flow a large current by contacting a high-conductivity member with a low-conductivity member, the current will not flow toward the low-conductivity member, and if it is intended to forcibly flow the current through the low-conductivity member (high-resistance member), the member generates heat, and this is quite dangerous.

Generally, however, for manufacturing reasons, the female connection member (the one element) is made of zinc soft iron plate or a brass plate which has good workability, and the electrical contact member (the other element) is made of a phosphor bronze plate or a copper plate which is inferior in workability. The former is inferior in electrical conductivity to the latter, and therefore it is clear that a large electrical resistance develops between the two members, thus causing the above-mentioned problem.

SUMMARY OF THE INVENTION

Therefore, it is an object of this invention to provide an electrical connection terminal in which the contact between members of different electrical conductivities is eliminated so as to reduce an electrical resistance at contact portions, thereby ensuring a higher safety, and the manufacture of the terminal is easy, and the terminal has such good electrical conductivity that it can be well suited for a large-current equipment such as an electric car.

The above object has been achieved by an electrical connection terminal comprising a male terminal having a rod-like male contact portion; a tubular female terminal having a through hole for receiving the male contact portion; a resilient contact member of an annular shape which is retained in the through hole along an axis, and can contact an outer peripheral surface of the male contact portion; and a conductor clamping portion and a covering clamping portion which are formed integrally with the female terminal at a rear end portion thereof through a retaining step portion, and extend in the axial direction; wherein the resilient contact member is made of a material having a good electrical conductivity, and has an integral clamping piece which extends through the through hole in the retaining step portion to the conductor clamping portion; the covering clamping portion fixedly clamps a conductor covering; and the conductor clamping portion fixedly clamps a conductor and the clamping piece together.

The above object has also been achieved by a construction in which the through hole has a contact portion-receiving chamber for fixing the resilient contact member in the axial direction which chamber is delimited by a constricted portion, provided adjacent to a front end of the through hole, and a constricted portion provided at the retaining step portion.

The above object has also been achieved by a construction in which the resilient contact member has an annular resilient contact portion and the clamping piece, the resilient contact portion and the clamping piece being electrically connected together by a conductive portion in the form of a narrow strip extending from the resilient contact portion in the axial direction, and a central portion of the resilient contact portion being constricted, and being resiliently deformable radially outwardly.

The above object has also been achieved by a construction in which the resilient contact member comprises the resilient contact portion, the clamping portion, and the conductive portion electrically interconnecting the resilient contact portion and the clamping piece, and is integrally formed of a single rigid metal plate having a good electrical conductivity.

The clamping piece, formed integrally with the resilient contact member, and the conductor are directly connected together by clamping at the conductor clamping portion, and therefore any point-contact portion does not exist between the conductor and the male terminal. Moreover, since the resilient contact member is integrally made of the good-conductivity material, the current hardly flows through the female terminal made of an ordinary electrically-conductive material, thereby achieving an excellent electrical conductivity.

DETAILED DESCRIPTION OF THE PREFERRED EMBODIMENTS

One preferred embodiment of an electrical connection member of the present invention will now be described with reference to the drawings.

Figure 1:
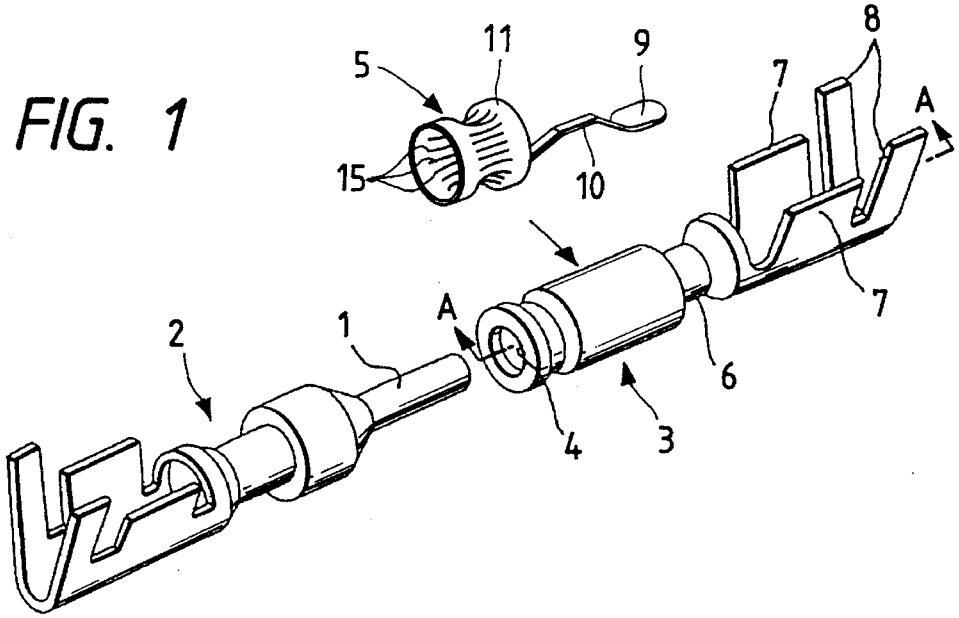
FIG. 1 is an exploded, perspective view of an electrical connection terminal of the present invention.

In FIG. 1, a male terminal 2, which is one element of the electrical connection member of the present invention, has a contact portion 1 in the form of a round rod, and a tubular female terminal 3 has a through hole 4 of a circular cross-section for receiving the male contact portion. The through hole 4 extends through a tubular portion of the female terminal 3 extending from its front end (with which the male terminal 2 is engaged) to a retaining step portion 6 from which a conductor clamping portion 7 extends. A detailed explanation of the male terminal will be omitted.

In the female terminal 3, a resilient contact member 5 is received in a generally central portion of the through hole 4 for slight axial movement along an axis A. Namely, the resilient contact member 5 is rolled in such a manner that a diameter thereof is decreased, and the resilient contact member 5 is inserted into a contact portion-receiving chamber 14 described later. After that one end portion of the female terminal 3 is squeezed to form a front constricted portion 12 described later.

The resilient contact member 5 is made of rigid metal of a good electrical conductivity, such as phosphor bronze, which is poor in workability but is low in electrical resistance. This contact member comprises an annular resilient contact portion 11 for contact with the outer peripheral surface of the male contact portion 1, and a clamping piece 9 formed integrally therewith. The resilient contact portion 11 is electrically connected to the clamping piece 9 by a conductive portion 10 in the form of a narrow strip extending axially from the resilient contact portion 11. The resilient contact portion 11 has a radially inwardly constricted portion 16 formed at an axially central portion thereof, and this constricted portion is resilient radially outwardly.

The retaining step portion 6 of a constricted configuration is formed at a rear portion of the female terminal 3, and is adapted to be secured to a side wall of an equipment directly or through a rubber bushing or the like. The female terminal 3 includes the conductor clamping portion 7 provided rearwardly of the retaining step portion 6, and a covering clamping portion 8 provided rearwardly of the conductor clamping portion 7. Each of the conductor clamping portion 7 and the covering clamping portion 8 is provided along the axis, and comprises a pair of blade-like flat plates in an open condition. The two clamping portions compressively clamp a conductor 20 and a conductor covering 21, respectively, at a final stage of the assembling operation.

Figure 4:
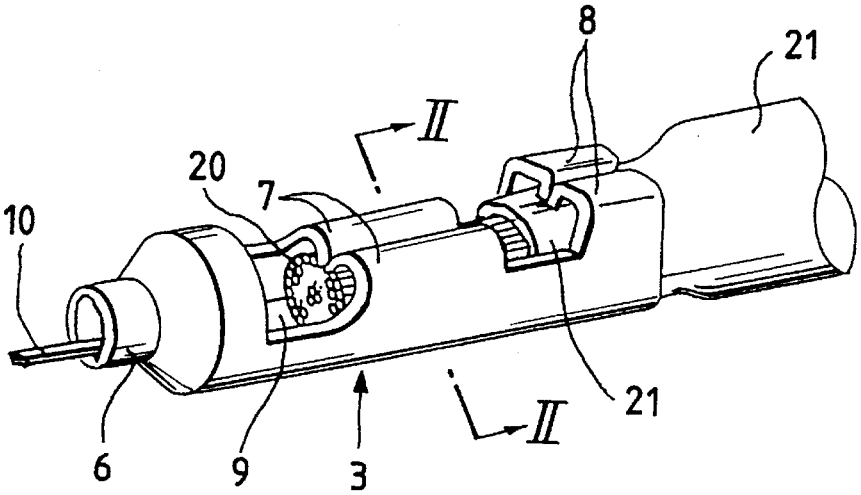
FIG. 4 is a perspective view showing the condition of clamping between a rear end portion of the female terminal of the electrical connection terminal of the invention and a conductor.
Figure 5:
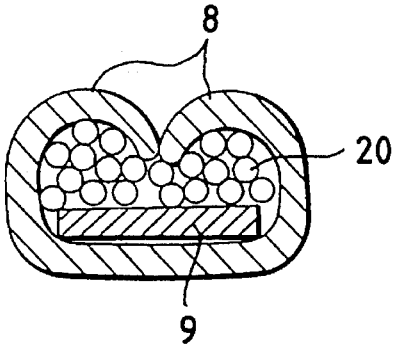
FIG. 5 is a cross-sectional view taken along the line II—II of FIG. 4.
Figure 6:
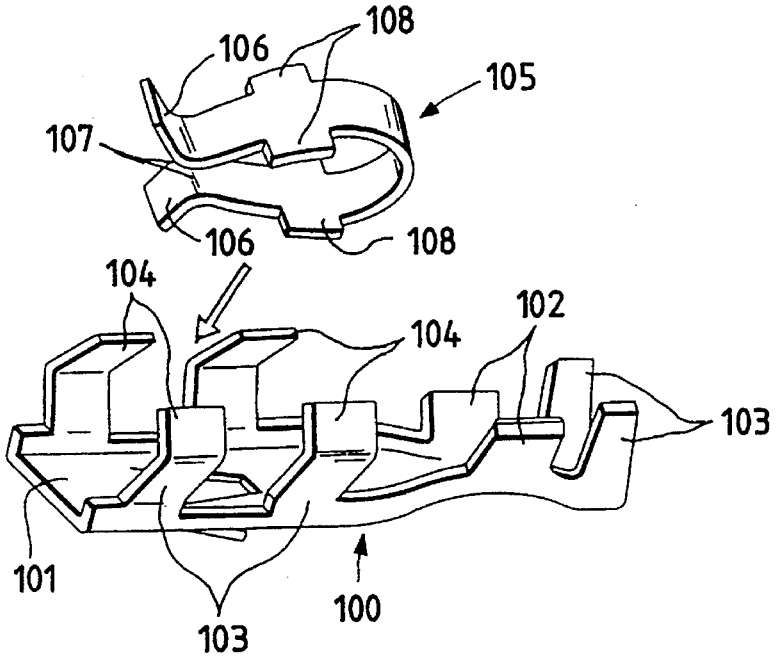
FIG. 6 is an exploded perspective view of a female connection member of a conventional electrical connection terminal.
Figure 7:
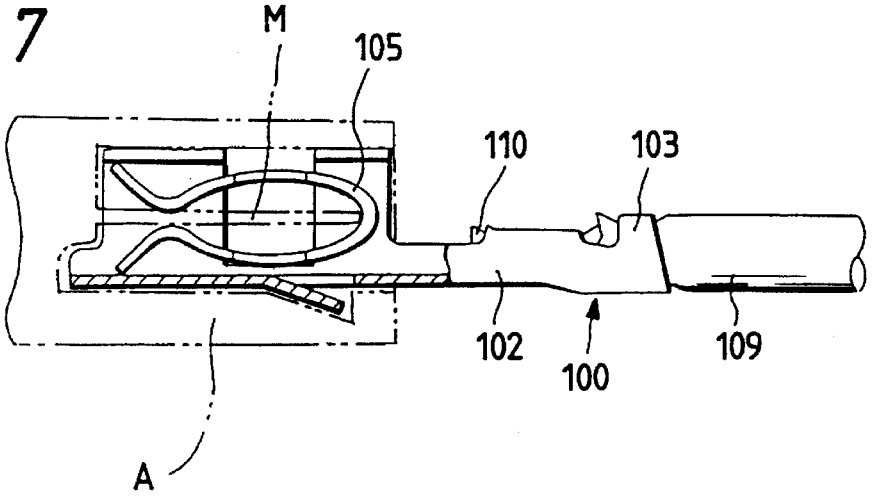
FIG. 7 is a view showing the manner of use of the conventional electrical connection terminal of FIG. 6.

Usually, each of such clamping portions is made of a material having an average electrical conductivity, and is compressively bent to provide a generally integral construction, as shown in FIGS. 4 and 5. In the present invention, however, since the clamping piece 9, electrically connected to the resilient contact member 5, is connected directly to the conductor 20, these clamping portions can be made of an electrically-insulative material, and depending on manufacturing and assembling conditions, the female terminal can be integrally molded of an insulative synthetic resin in such a manner that a material, such as an aluminum piece, which is inexpensive or can be easily clamped, is inserted in the terminal body.

Figure 3:
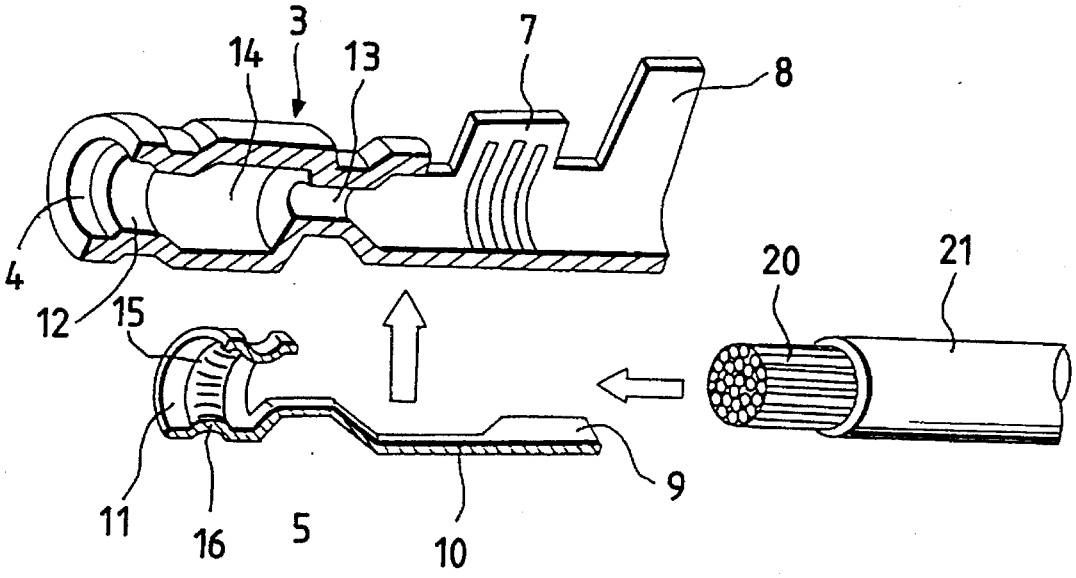
FIG. 3 is a cross-sectional view taken along the line I—I of FIG. 1, showing the assembling of a female terminal.

The through hole 4 in the female terminal 3 has the front constricted portion 12 provided adjacent to the front end thereof, and this constricted portion 12 serves to position the male contact portion 1 in a radial direction when the male contact portion is inserted into this through hole. As shown in FIG. 3, this constricted portion also cooperates with a rear constricted portion 13 to delimit the contact portion-receiving chamber 14 extending in the axial direction for retaining the resilient contact member 5 along the axis, the rear constricted portion 13 being defined by the inner surface of the constricted retaining step portion 6. Therefore, the conductive portion 10 of the resilient contact member 5 is bent into a generally trapezoidal contour so as to extend through the rear constricted portion 13 to the conductor clamping portion 7. As shown in FIG. 5, a number of conductor wires are placed in a bundled manner on the clamping piece 9 connected to the conductive portion 10 at the conductor clamping portion 7, thereby achieving a good electrical contact. The length of the contact portion-receiving chamber 14 is greater than the axial length of the resilient contact portion 11, thereby allowing the constricted portion 16 to resiliently deformed radially outwardly.

Figure 2:
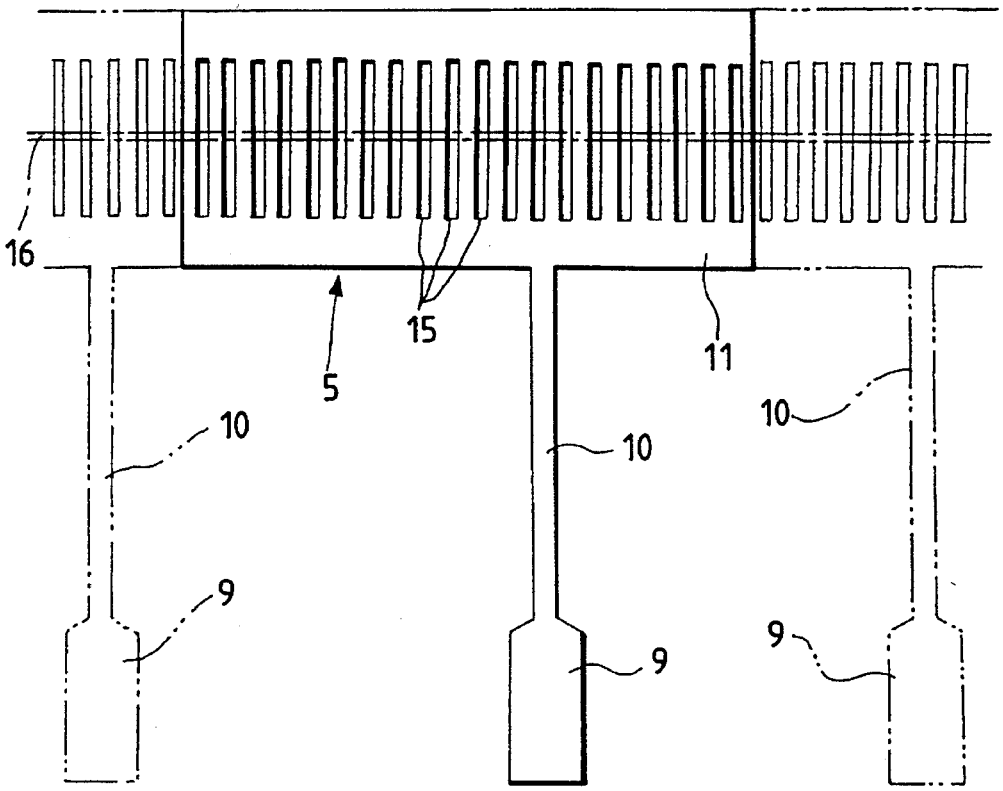
FIG. 2 is a developed, plan view of a resilient contact member used in the electrical connection terminal of the invention.

As is clear from FIG. 2, the resilient contact portion 11 has a rectangular shape at a production stage, and a number of juxtaposed slits 15, which provides the resiliency of the constricted portion 16, are formed at equal intervals through a central band-like region thereof intermediate the opposite ends of the resilient contact portion 11.

In the manufacture of the resilient contact member 15, a single product (as shown in the drawings), having the resilient contact portion 11, the clamping piece 9, and the conductive portion 10 electrically interconnecting them, may be produced by blanking (pressing) from a single rigid metal sheet of a good electrical conductivity. However, in the case of a mass-production, most preferably, a plurality of products (shown in the drawings) are preformed in a continuous manner in a longitudinal direction (in a right-left direction in the drawings), and this integral structure is cut into a predetermined length at a region between the adjacent slits, thereby providing a single product. At a finishing stage, preferably, the opposite ends are bonded together by spot welding or brazing to form an annular shape, and then the axial central portion is constricted by a mandrel or the like from the outside to provide the constricted portion 16. The slits 15 do not always need to be disposed perpendicular to the longitudinal direction, and they may be slightly inclined in so far as a sufficient resilient effect can be achieved, and it is only necessary that the slits should extend generally in the axial direction in a finished condition if wear or other problem are not encountered when fitting the male contact portion 1.

In the illustrated embodiment, although the clamping piece 9 is in the form of a rectangular flat plate, it is preferred that the clamping piece be curved along the axial direction if the clamping piece is mated with a side wall of the conductor clamping portion, and where the clamping portion is of a tubular shape, better results are obtained with such a construction.

As described above, in the electrical connection terminal of the present invention, the female terminal is made of a material having an average electrical conductivity, and the resilient contact member is made of a material having a good electrical conductivity. Therefore, most of the current, flowing through the conductor, flows into the male contact portion through the resilient contact member, and will not flow into the other portions. Therefore, the female terminal can be integrally molded of a material having an extremely-low electrical conductivity or an excellent moldability, such as a synthetic resin. The members of two different electrical conductivities are used, and the portions of contact between these members are eliminated as much as possible, and therefore the risk of generation of heat due to a contact resistance and a concentrated resistance is avoided, and the productivity can be greatly enhanced.

What is claimed is:

1. An electrical connection terminal comprising:

a terminal body including:

a through hole passing through a terminal body in an axis direction of the terminal body;

a conductor clamping portion and a covering clamping portion which are formed integrally at a rear end portion thereof through a retaining step portion, and extend in the axial direction; and a resilient contact member of an annular shape which is retained in said through hole along an axis, and the resilient contact member contacting an outer peripheral surface of a male contact portion at its surface, said resilient contact member being made of a material having an electrical conductivity which is not less than an electrical conductivity of the terminal body, and the resilient contact member having an integral clamping piece which extends through a through hole in said retaining step portion to said conductor clamping portion, wherein said covering clamping portion fixedly clamps a conductor covering, and said conductor clamping portion fixedly clamps a conductor and said intergral clamping piece together.

2. An electrical connection terminal as claimed in claim 1, in which said through hole has a contact portion-receiving chamber for fixing said resilient contact member in the axial direction, the contact portion-receiving chamber is defined by a constricted portion which is provided adjacent to a front end of said through hole, and a constricted portion provided at said retaining step portion.

3. An electrical connection terminal as claimed in claim 1, in which said resilient contact member has an annular resilient contact portion and said clamping piece, said annular resilient contact portion and said clamping piece being electrically connected together by a conductive portion in the form of a narrow strip extending from said annular resilient contact portion in the axial direction, and a central portion of said annular resilient contact portion is resiliently deformable radially outwardly.

4. An electrical connection terminal as claimed in claim 1, wherein said resilient contact member includes an annular resilient contact portion, a clamping portion and a conductive portion electrically interconnecting the annular resilient contact portion and the clamping piece, and said resilient contact member is integrally formed of a single rigid metal plate having an electrical conductivity which is not less than an electrical conductivity of the terminal body.

* * * * *